United States Patent [19]

Walters

[11] 3,933,489

[45] Jan. 20, 1976

[54] ELECTROSTATIC REPRODUCTION PROCESS EMPLOYING NOVEL TRANSFER PAPER

[75] Inventor: Wally Z. Walters, West Springfield, Mass.

[73] Assignee: Preco Corporation, West Springfield, Mass.

[22] Filed: Feb. 21, 1974

[21] Appl. No.: 444,296

Related U.S. Application Data

[62] Division of Ser. No. 237,797, March 24, 1972, Pat. No. 3,873,354.

[52] U.S. Cl. ..... 96/1.4; 427/24

[51] Int. Cl.[2] ..... G03G 13/16; G03G 13/22

[58] Field of Search ..... 96/1.4; 117/201; 162/138; 427/24

[56] References Cited

UNITED STATES PATENTS

| | | | |
|---|---|---|---|
| 3,075,859 | 1/1963 | Relph et al. | 117/152 X |
| 3,116,147 | 12/1963 | Uber et al. | 162/138 X |
| 3,148,107 | 9/1964 | Selke et al. | 162/145 X |
| 3,216,853 | 11/1965 | Gess | 117/201 |
| 3,337,392 | 8/1967 | Carlson et al. | 162/138 |
| 3,385,730 | 5/1968 | Relph | 162/138 X |
| 3,420,734 | 1/1969 | Anderson et al. | 162/138 X |
| 3,440,090 | 4/1969 | Matsunaga | 117/201 |
| 3,493,412 | 2/1970 | Johnston et al. | 117/155 X |
| 3,619,279 | 11/1971 | Johnston et al. | 117/155 |
| 3,672,930 | 6/1972 | Trachtenberg | 117/37 LE |
| 3,814,599 | 6/1974 | Cree | 96/1.4 |

*Primary Examiner*—David Klein
*Assistant Examiner*—John R. Miller
*Attorney, Agent, or Firm*—Strauch, Nolan, Neale, Nies & Kurz

[57] ABSTRACT

Electrostatic reproduction processes utilizing papers which have a surface resistivity of not more than 0.9–3 × $10^{11}$ IPC ohmn/square at a relative humidity of 25 percent and a surface resistivity of not more than 25–60 × $10^{11}$ IPC ohms/square at a relative humidity of 10 percent.

9 Claims, 9 Drawing Figures

FIG. 4
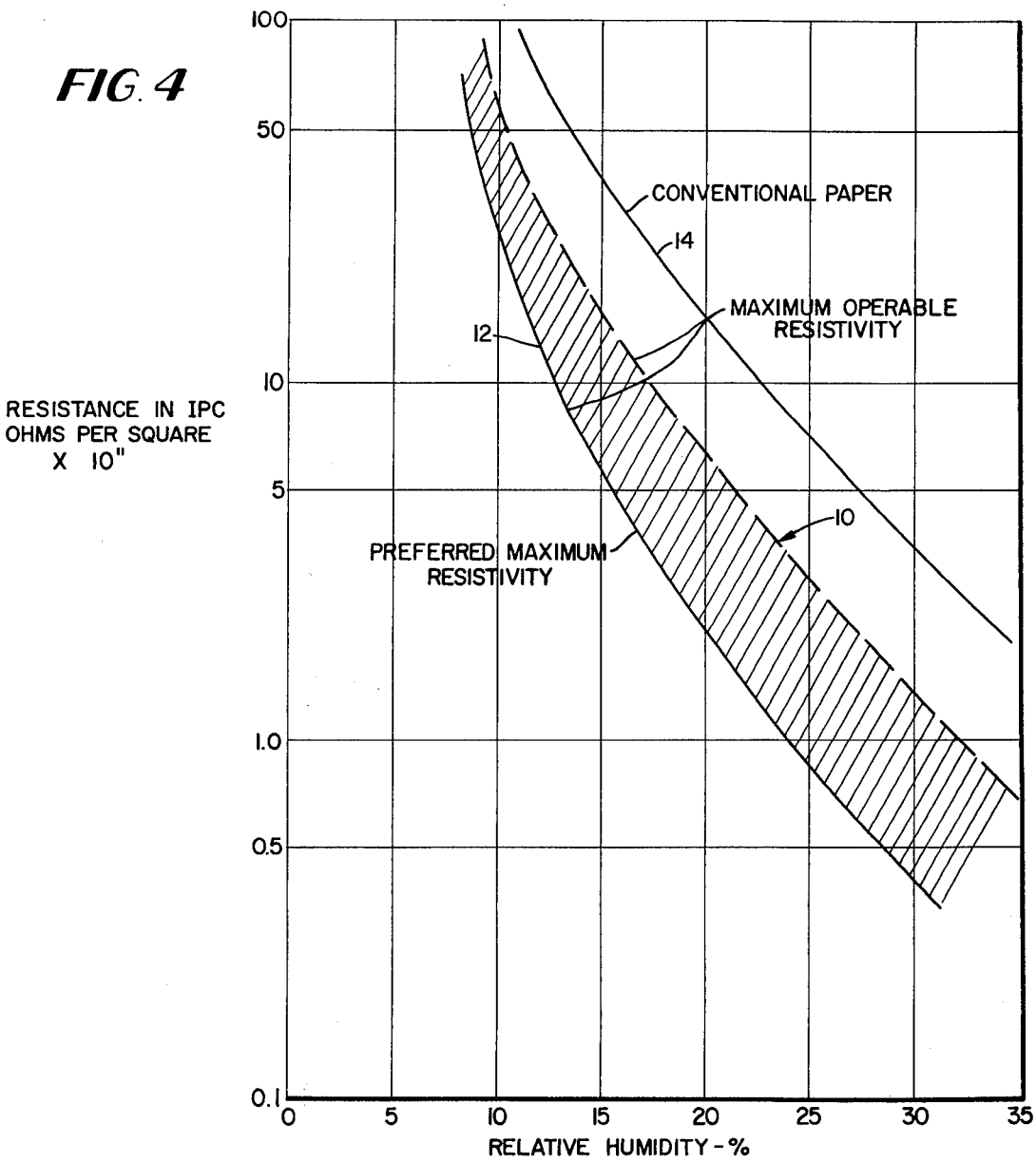
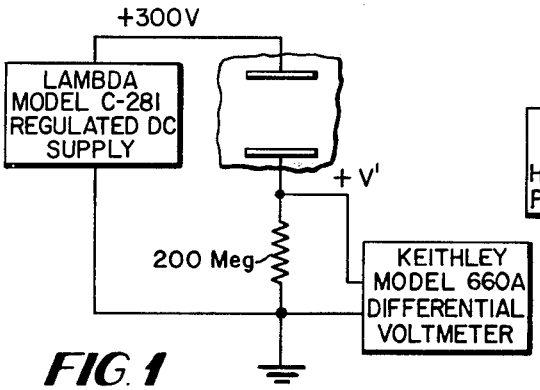
FIG. 1
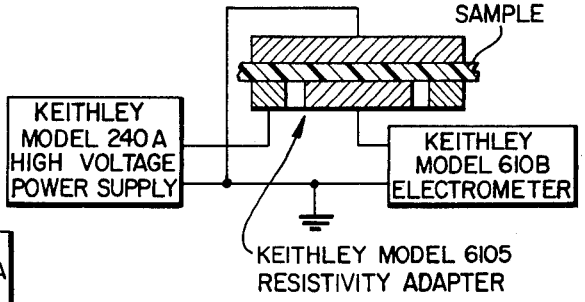
FIG. 2

ELECTROSTATIC REPRODUCTION PROCESS EMPLOYING NOVEL TRANSFER PAPER

This application is a division of application Ser. No. 237,797 filed Mar. 24, 1972, now U.S. Pat. No. 3,873,354.

The invention relates in one aspect to improving electrostatic printing processes by the utilization of papers having electrical properties tailored so that static charges will not accumulate on the paper during the printing process.

In electrostatic printing processes, a high voltage corona discharge or comparable unit is employed to produce a uniform distribution of electrical charges on the surface of a drum other member. The charges are then dissipated from selected areas of the charged member to produce a latent, electrostatic image.

To develop the latent image, the selectively charged member is contacted with a toner which includes finely divided particles containing pigment and a binder. These particles adhere to those areas of the charged member where a charge is present.

Paper is then brought into contact with the charged member, and the charges on it are dissipated. This transfers the toner to the paper which, at the same time, becomes electrostatically charged.

Immediately thereafter, the paper is subjected to intense heat, melting the binder and fusing the pigment particles to the paper. The paper is then allowed to cool to complete the process.[1]

[1] This process is to be distinguished from that in which the latent electrostatic image is formed directly on paper having a zinc oxide or other conductive coating. The present invention is not concerned with this type of process, and the conductive papers employed in it are not interchangeable with those I have invented as will become apparent hereinafter.

The high intensity heat sources employed in modern electrostatic reproduction machines produce very low relative humidities[2] in the vicinity of the heat source. Consequently, as the toner particles are fused to the paper, residual moisture is rapidly driven out of the paper with a corresponding decrease in its conductivity. As the conductivity of the paper decreases, it becomes more and more retentive of the charges transferred to it with the toner. And, also because of its decreasing conductivity, it tends to pick up additional charges because of the close proximity of the high voltage charge generating unit. Also, as the decreasingly conductive paper runs over the rolls, etc. in the reproduction machine, friction will cause additional static charges to be built up on the paper.

[2] The term "low relative humidity" will be used frequently herein. In the context of the present invention this term refers to relative humidities of from about 25 to 10 percent or lower.

Modern electrostatic machines operate at extremely high rates (machines capable of producing well over 100 copies per minute are commercially available). These machines are typically equipped with auxiliary units for segregating and collating the copies produced by the duplicator to minimize the hand labor involved in reproducing multi-page documents such as books, pamphlets, and the like.

Reproduction equipment of the type just described is highly susceptible to stoppages attributable to the jamming of paper both in the duplicating machine itself and in the collation equipment. This is in part because the charges on the paper cause the sheets to stick together so that they cannot be properly manipulated by the various paper handling mechanisms. Also, because of the static charges, the sheets stick to the rolls and other conveying devices in the machine.

Stoppages are undesirable because of the time wasted in cleaning out the jam and because of the wastage. In fact, in some cases, it has been found preferable to return to hand sorting and collating because of the frequency with which jams occurred in the collating unit of high speed electrostatic reproduction equipment.

Several solutions to this stoppage problem have been proposed and tried. For example, it was in one instance concluded that jamming is related to the stiffness of the paper which is used. Accordingly, stiffer papers were made by incorporating materials such as sodium silicate in them. This did not produce any marked improvement.

It has also been suggested that surface coatings could solve the problem. A number of these, including polyethylenes, have been tried without noticeable success.

I have now found that the key to preventing the accumulation and retention of electrostatic charges on the paper and thereby eliminating the problem discussed above is the conductivity or resistivity of the paper at the low relative humidities which exist in electrostatic reproduction machines. More specifically, I have found that, if paper is so formulated that its surface resistivity varies from not more than $0.9–3 \times 10^{11}$ IPC ohms/square at a relative humidity of 25 percent to not more than $25–60 \times 10^{11}$ IPC ohms/square at a relative humidity of 10 percent, accumulation and retention of static charges ceases to be a problem as the charges will readily dissipate from the paper; and the jamming attributable to static charges will not occur in high speed machines, even if they are equipped with collation devices.

Papers with even lower surface resistivities than the maximums set forth in the preceding paragraph are preferred. They will function satisfactorily under even the most adverse conditions.

The term "IPC ohms/square", used above, has a particular significance. Surface resistivities of the magnitudes with which the present invention is concerned are on the fringe of man's ability to measure; and values varying by an order of magnitude or more can be obtained from the same sample depending upon the instrumentation which is used, the voltage at which the resistivity is measured, and the conditions under which the measurement is made (see, for example, Resistivity Testing Methods for Conductive Base Paper, Cooprider, TAPPI 51, No. 11, pp. 520–527 (November 1968)). Thus, surface resistivity values are meaningless unless they are tied to the particular technique and instruments by which they are obtained.

Resistivities in IPC ohms/square are measured by the following technique: the sample is placed in an enclosure in which the humidity can be controlled (to an accuracy of less than ± 1 percent). The humidity is adjusted to an initial, relatively high level and the sample allowed to reach equilibrium. The humidity is then decreased to the desired level so that the resistivity will be measured on the drying side of the paper's hysteresis curve and the humidity kept constant until equilibrium is again reached.

The sample is then placed on a $1.3 \times 15.5 \times 15.5$ cm sheet of polymethyl methacrylate fastened to a steel plate with a sheet of 0.04 mm thick Teflon sandwiched between the plate and the acrylic for added insulation. Brass electrodes $1.95 \times 1.95 \times 5$ cm long mounted at a spacing of 5.0 cm on polymethyl methacrylate insulating supports and surrounded by an electrostatic shield are then pressed against the paper with a force of 40 Kg by an air cylinder with a ball and socket connection being used to prevent misalignment and insure good contact between the electrodes and the paper.

The electrodes are connected in series with a 200 megaohm resistance and a Lambda Model C-281 Regulated Power Supply adjusted to produce a 300 volt d.c. output. The voltage drop V′ across the 200 megaohm resistance is measured with a Keithley Model 660A Differential Voltmeter. (The test set-up and instrumentation is shown schematically in FIG. 1). The surface resistivity $R_p$ of the paper is then calculated by the following formula:

$$\frac{V'}{200 \text{ Mohm}} = \frac{300\ V}{R_p + 200 \text{ Mohm}}$$

Coonventional papers have surface resistivities which are well above those I have found usable for the purposes of the present invention. Accordingly, it is necessary to change the electrical properties of such papers for my purposes. This may be done in any manner which is desired as it is the particular electrical properties of the paper which are critical, not the manner in which these properties are imparted to it.

One method of decreasing the resistivity of conventionally formulated and made papers to the requisite levels is to uniformly distribute a readily ionizable salt in the surface portions of the paper. The salt may be added to the stock before the paper is formed. Alternatively, the paper can be formed and dried and then passed through a sizing press. Here it is contacted with an aqueous solution of the selected salt to transfer the requisite amount of the salt to the paper. This is followed by another drying step and the customary finishing operations.

Any of a wide variety of ionizable inorganic and organic salts may be employed in the practice of the present invention as the key is not the use of a particular salt but the tailoring of the paper so that it will have certain specific levels of resistivity at very low relative humidities as explained above.

The requisite characteristics of the salt are that it be soluble in water, that it be non-volatile, and that it be a good electrolyte. Also, for many, if not most, applications of the invention, the salt should not impart color to the paper. In addition, it should not discolor or degrade at drying temperatures of up to 250°C.

Examples of salts of the type which are satisfactory in the practice of the present invention are:

Sodium Chloride
Potassium Chloride
Calcium Chloride
Magnesium Chloride
Aluminum Chloride
Sodium Aluminate
Potassium Aluminate
Potassium Benzoate
Potassium Borate
Sodium Benzoate
Sodium Bisulfite
Sodium Borate
Sodium Bromate
Sodium Manganate
Sodium Metaphosphate The amount of salt that is employed will depend upon the particular compound selected. Because the resistivity with which the present invention is concerned is a surface effect or phenomena, the amount of salt that is employed can be most usefully expressed as weight of salt per standard sheet of paper. A "standard sheet of paper" as that term is employed herein is one which is 8½ × 11 inches.

An amount of sodium chloride that has been found satisfactory in the field is 0.012 grams per standard sheet. The following table shows the amounts of representative salts I have found to be equivalent as far as the present invention is concerned; it accordingly provides a guide for selecting add-on amounts of salts other than sodium chloride which will produce satisfactory results:

| Compound | Grams of Salt per Standard Sheet |
|---|---|
| Sodium Chloride | 0.0012 |
| Potassium Chloride | 0.002 |
| Aluminum Chloride | 0.007 |
| Calcium Chloride | 0.004 |

A humectant may also advantageously be added to the paper, typically by incorporating it in the same solution as the ionizable salt.

It is my experience that conventional humectants, by themselves, are of little practical value in decreasing the surface resistivity of paper. However, field experience clearly shows that such humectants do act synergistically to make the salt more effective at at least the lowest of the relative humidities with which the present invention is concerned.

The particular humectant which is employed is not critical, and any of a number of such materials may be employed. The important requisites are that the humectant be soluble in or miscible with water, that it not adversely effect the color of the paper, and that its boiling point be high enough that it will not escape from the paper in significant amounts at drying temperatures of up to 250°C.

Glycerin is one suitable humectant. Others include sorbitol, ethylene glycol, propylene glycol, polyethylene glycols and polymers, and mixtures of the foregoing as well as mixtures including glycerin.

The amount of humectant used will vary, depending upon the particular material which is selected. The minimum amount is that which will increase the effectiveness of the salt at very low relative humidities while the maximum is dictated by the requirement that the treated paper retain its paperlike qualities at normally encountered relative humidities of 50 percent and above. If an excess of humectant is used, the paper will become limp and entirely unacceptable from a physical standpoint at such humidity levels.

As mentioned above, glycerin is one suitable humectant. A typical application of the invention will use 1½ pounds of glycerin per ton of paper.

Another additive which will typically be added to the size press solution is a conventional binder such as a starch, gum, casein, polyvinyl alcohol or acetate, animal glue, etc.

The papers of the present invention are to be clearly distinguished from the multitude of so-called anti-static and conductive papers which have heretofore been developed for other purposes.[3,4] As discussed by a number of investigators including Hayek (TAPPI, 43, No. 2, pp. 105–112, February 1960) and Uber (U.S. Pat. No. 3,116,147) the surface resistivity which paper must have for a given use is a complex, not readily ascertainable characteristic. It must instead be specifically determined for each situation and the paper tailored to provide the requisite resistivity characteristics.

[3] The papers of the present invention are not conductive in any normal sense, but have sufficiently high resistivities as to make them good insulators in common parlance.

[4] Examples of "prior art" conductive and anti-static papers are described in U.S. Pats. Nos. 1,889,851 issued Dec. 6, 1932; 2,040,142 issued May 12, 1936; 2,086,544 issued July 13, 1937, 2,229,091 issued Jan. 21, 1941; 2,283,558 issued May 19, 1942; 2,328,198 issued Aug. 31, 1943; 2,346,370 issued Apr. 18, 1944; 3,372,829 issued Apr. 3, 1945; 2,667,651 issued May 4, 1954; 2,983,654 issued Nov. 6, 1962; 3,075,859 issued Jan. 29, 1963; 3,116,147 issued Dec. 31, 1963; issued Jan. 29, 1963; 3,116,147 issued Dec. 31, 1963; 3,142,562 issued Aug. 28, 1964; 3,293,115 issued Dec. 20, 1966; 3,385,730 issued May 28, 1968; 3,420,734 issued Jan. 7, 1969; and 3,440,090 issued Apr. 22, 1969.

Thus, that the papers described in the foregoing patents are suitable for the wet process photoreproduction, electrographic recording, videographic, Alfax-type, and other processes with which the patents are concerned is no indication that those papers are satisfactory for any application other than that for which they were specifically designed, let along the specific application for which the papers I have invented are intended. This is confirmed by the complete absence of any statement in these patents that the papers disclosed therein can be used in the type of electrostatic printing process described above.

That the novel papers disclosed herein operate satisfactorily at low relative humidities is a surprising result. Carlson (U.S. Pat. No. 3,337,392 issued Aug. 22, 1967); Hayek (TAPPI 43, cited above); Matsunaga (U.S. Pat. No. 3,440,090 issued Apr. 22, 1969); and Vaurio (TAPPI 47, No. 12, pp. 163A–165A (December 1964)) all state that ionizable salts are not effective in decreasing the resistivity of paper at low relative humidities; and I know of no investigator who has reported otherwise. Similarly, Vaurio states, as is commonly accepted, that the addition of humectants does not provide any beneficial results at low relative humidities. Again, I have found that this in incorrect for papers having the resistivities described above when they are used as intended.

The Carlson Patent just referred to describes paper which are said to be useful for electrostatic printing among other applications. However, as the paper is to be coated with zinc oxide for this application, it is apparent that Carlson is not concerned with paper for the same application as that disclosed herein but with the type of electrostatic duplicating process in which the latent electrostatic image is formed directly on the copy sheet. It is equally apparent from the Hayek and Uber references that the two processes (mine and Carlson's) require papers of different characteristics. Thus, Carlson's teachings are clearly not relevant to my invention.

In conjunction with the foregoing, Carlson employs hydrated asbestos fibers to decrease the surface resistivity of the papers disclosed in his patent. While such papers may have resistivities which make them useful at the 30 to 50 percent relative humidities discussed in the patent, they would not necessarily have the characteristics required at the much lower relative humidities (on the order of ten percent) which are typically found in the more modern, higher speed machines of the type for which the papers disclosed herein are designed. This again is because the key to satisfactory performance is the tailoring of the electrical properties of the paper to specified criteria, and this cannot be obtained merely by incorporating one additive or another in the paper without knowing what the requisite criteria are.

From the foregoing it will be apparent that one primary object of the present invention resides in improving electrostatic printing and duplicating techniques by minimizing problems attributable to the accumulation of static charges on the copy sheets.

Other important objects and features of the invention as well as additional advantages will be apparent from the foregoing description of it, from the appended claims and accompanying drawing, and from the examples set forth below which are intended to illustrate the present invention but not to limit the scope of protection which is sought.

In the drawing just referred to:

FIG. 1 is a schematic illustration of a test set-up and instrumentation for measuring surface resistivity in IPC ohms/square;

FIG. 2 is a schematic illustration of a test set-up and instrumentation for measuring surface resistivity in Lincoln ohms/square;

FIG. 4 is a chart depicting the surface resistivity characteristics which papers must have to make them useful for the purposes described herein;

Figure 3:
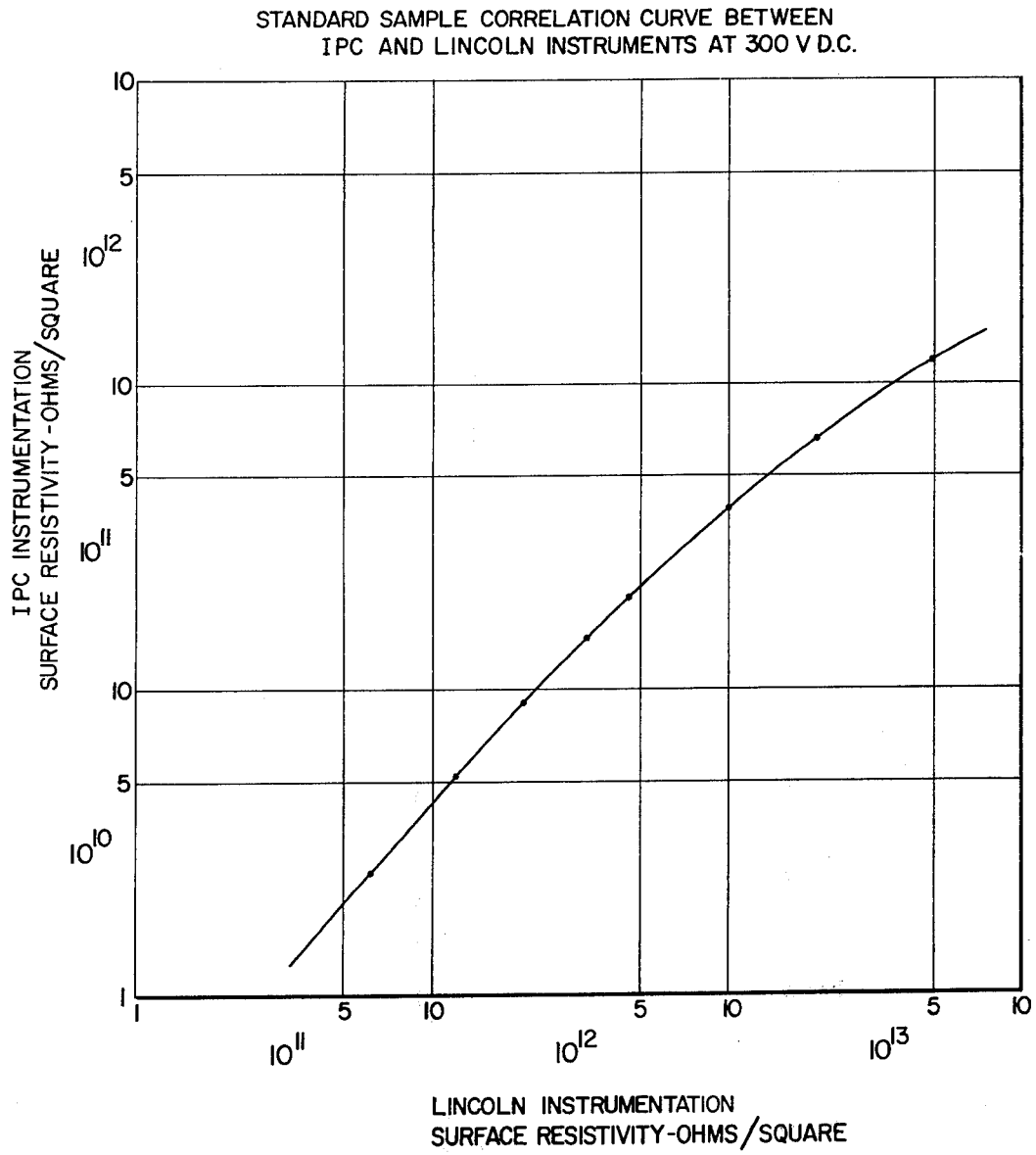
FIG. 3 is a correlation curve for converting Lincoln ohms/sqare to IPC ohms/square and vice-versa.

Referring now to the drawing, it was pointed out above that paper must have certain specific surface resistivity characteristics at low relative humidities to make it useful for the purposes of the present invention. More specifically, the paper must have a resistivity which, for a given low relative humidity, is in or below the region identified by reference character 10 in FIG. 4 and is preferably not above the lower boundary of region 10 established by curve 12.

As can be seen from FIG. 4, the resistivity characteristics of papers which are useful for the purposes of the present invention are quite different from those of conventional paper which will typically have a resistivity versus relative humidity curve such as that identified by reference character 14 in FIG. 4.

As discussed above, papers which are suitable for the purposes of the present invention can be prepared in any manner desired as long as the paper has the requisite electrical properties. I also pointed out that one way of obtaining these characteristics is by incorporating a readily ionizable salt in the surface portions of the paper and that this approach is entirely unobvious from the prior art which uniformly teaches that papers treated with ionizable salts alone are not capable of preventing static charge accumulation at low relative humidities. That the prior art teaching is not correct for electrostatic printing and duplicating processes as described above if the salt is so added as to alter the resistivity characteristics of the paper in the previously described, required manner is apparent from the following example.

EXAMPLE I

A 20 pound, 17 × 22-500, chemical pulp, unsized paper was cut into 5½ × 8½ inch strips (a half standard sheet).

A 7 percent by weight solution of enzyme converted potato starch[5] in water was cooked and cooled to a temperature of 140°F.

[5] Co-Star brand available from the Colby Co-op of Colby, Maine.

Sodium chloride and glycerin were added to different portions of the hot starch solution in amounts producing concentrations of 0.1, 0.4, 1.0, and 5.0 percent based on the bone dry weight of the solids present in each formulation (glycerin was treated as a solid in calculating the concentrations).

Specimens of the paper were then dried to constant ("bone dry") weight, weighed, and coated with each of the foregoing solutions using a wringer type laboratory size press. The coated samples were then again dried to constant weight and reweighed, the difference in the bone dry weights being the total amount of additive added to the sample in the coating step. From these weights and with the precentages of the different constituents in the solids portion of the sizing solution known, the amount of sodium chloride or glycerin added to each half standard size sheet specimen could be and was calculated.

The foregoing specimens, together with an untreated or unsized sample, were exposed to a relative humidity above 50 percent until equilibrium was reached. The relative humidity was then reduced to 50 percent, equilibrium established, and the resistivity of the samples measured using the Lincoln instrumentation shown in FIG. 2. The process was then repeated, the relative humidity being successively lowered to 36.7 percent, 21.4 percent, and 13.0 percent and equilibrium being established at each relative humidity level before the resistivity measurements were made.

Next, the resistivities were converted to IPC ohms/-square using the correlation curve of FIG. 3.

For the treated specimens, plots were made of resistivity versus weight of material added for each of the relative humidity levels at which the resistivity of the samples was measured. For sodium chloride this resulted in the family of curves shown in FIG. 9. A similar family of curves (not shown) was obtained for the samples treated with glycerin.

Figure 9:
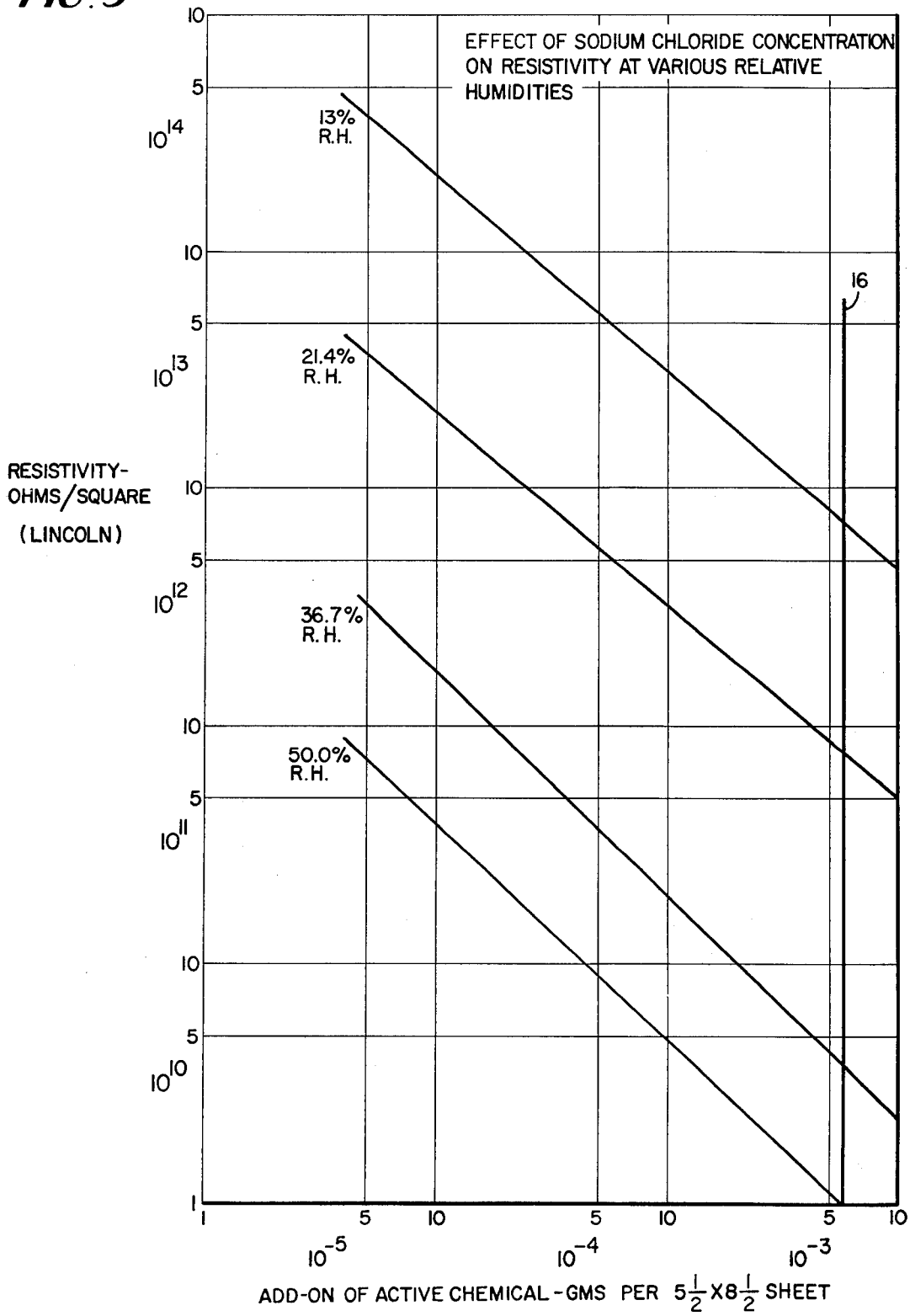
FIG. 9 is a graph showing the effect which the amount of ionizable salt added to paper has on its resistivity at different relative humidity levels.

A vertical line at the sodium chloride add-on weight of 0.006 grams (identified as 16) was then drawn on the FIG. 9 plot. The points where line 16 crossed the previously plotted curves were the resistivities of the sample at the above-identified relative humidity levels for the selected add-on weight. Through these points the curve of FIG. 5 for the sodium chloride treated paper was drawn.

Figure 5:
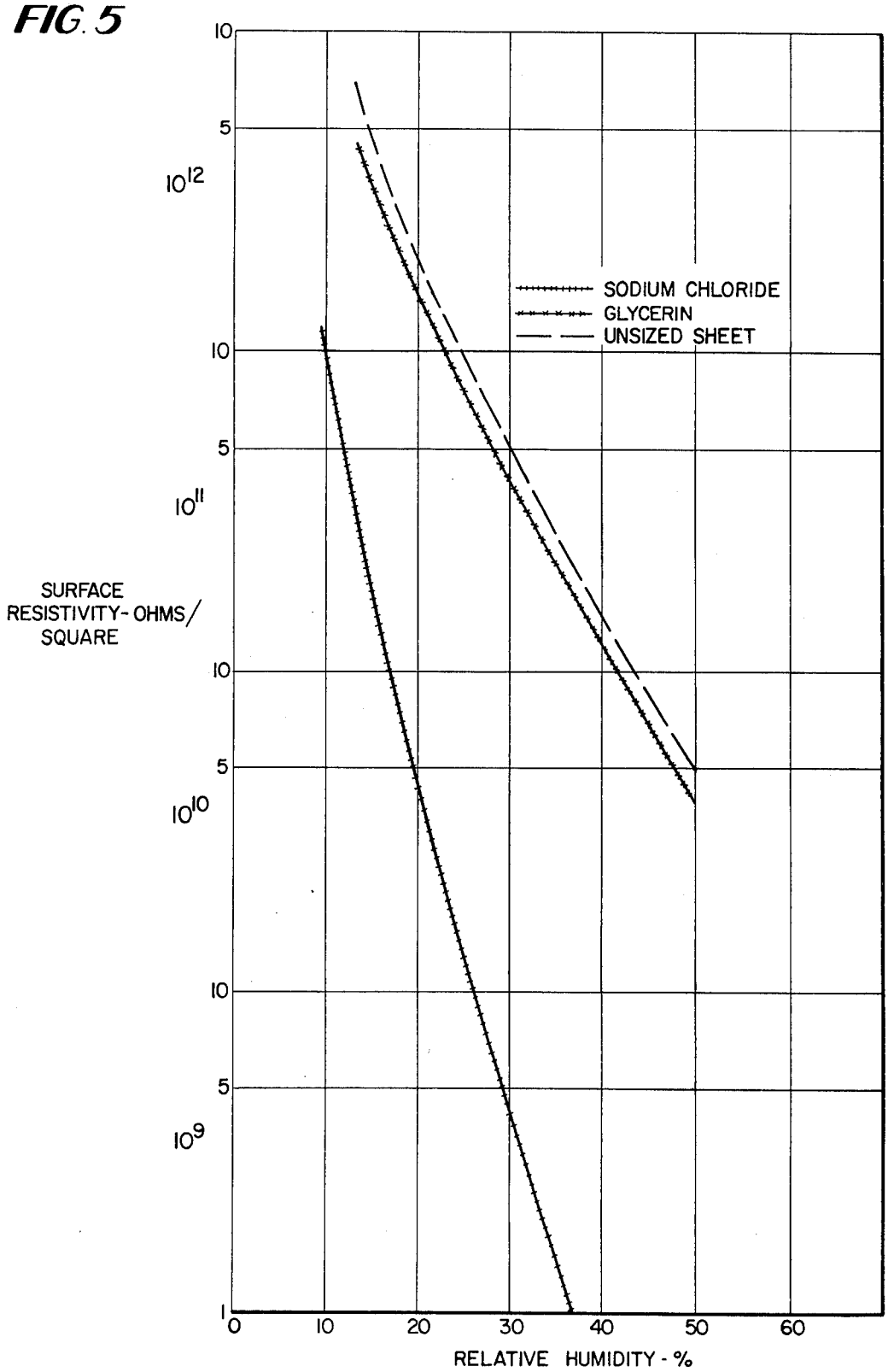
FIG. 5 is a chart in which papers in accord with the present invention are compared with untreated but otherwise comparable paper and with paper to which only a humectant has been added.

The resistivity versus relative humidity curve for glycerin treated paper at an add-on weight of 0.002[6] grams per half standard sheet in FIG. 5 was obtained in a similar manner. The curve for the untreated specimen was then added to FIG. 5. This curve was obtained in a straightforward manner by plotting resistivity versus relative humidity for each of the four levels at which measurements were made and drawing curves through the resulting points.

[6] Add-on weights of 0.002 and 0.006 grams per half standard sheet of the sodium chloride and glycerin treated specimens were selected because these levels have been found to give excellent performance in the field.

The data shown in graphical form in FIG. 5 confirms a number of the unique discoveries I have made. First, this data shows that ionizable salts are capable of producing the resistivity characteristics required for the present invention although the prior art would lead one to conclude otherwise.

Next, the data (especially FIG. 9) shows that the resistivity characteristics required in the practice of the present invention can be obtained by appropriately varying the amount of ionizable salt added to the paper.

Finally, a comparison of FIGS. 4 and 5 shows that untreated papers as well as those treated only with a conventional humectant are not satisfactory for the purposes of the present invention.

Much of the foregoing has been confirmed and other of the unique and unobvious theoretical aspects of my invention verified in commercial scale field trails. The following is is concerned with one of many series of such field trials and also illustrates the commercial scale preparation of paper in which the electrical properties required by my invention are obtained by the incorporation of a readily ionizable salt in the paper.

EXAMPLE II

A paper of the type contemplated by the present invention was prepared by making a 20 pound, 17 × 22-500, chemical pulp paper on a papermaking machine and drying the paper to a moisture content of 5 percent. This paper was coated in a sizing press with an aqueous sizing solution containing 700 pounds of Co-Star enzyme converted potato starch, 40 pounds of sodium chloride, and 6 gallons of glycerin per 1000 gallon batch. The coating solution was applied at a rate which resulted in between 93 and 95 pounds of solids per ton of paper being transferred to the paper. After the sizing step the paper was again dried to a moisture content of 5 percent and then calendered. To insure that the paper had satisfactory electrical characteristics, the resistivities of samples of the paper were measured at a relative humidity of approximately 15 percent following the procedure of Example I.

This was followed by a second trial run in which the glycerin was reduced to 3 gallons per batch and by a third trial run in which the level of sodium chloride was decreased to 30 pounds per batch and the glycerin decreased to 1.5 gallons per batch.

Performance tests of papers from the three runs in electrostatic duplicating machines confirmed that ionizable salts are capable of producing the resistivity characteristics I require. The variations in performance of the three papers also clearly demonstrated that the amounts of the additives employed must be selected with care to produce optimum results. Finally, these tests did clearly indicate that a conventional humectant such as glycerin has a useful potentiating or synergistic effect on the surface resistivity decreasing capabilities of ionizable salts at very low relative humidities, an effect which is quite surprising in light of the heretofore accepted view that conventional humectants are ineffective in changing the electrical properties of papers at such relative humidities.

I pointed out previously that the particular ionizable salt which is employed to obtain the requisite electrical characteristics if that approach is followed is not critical as long as the salt has the properties listed above. This was confirmed by the tests described in the following example.

EXAMPLE III

Representative ionizable salts in amounts producing the same concentrations as in Example I were added to portions of the starch solution prepared as therein described. Similar specimens were coated using the laboratory sizing apparatus. The specimens were dried and their resistivity measured at the humidity levels of Example I using the same procedure. The particular salts selected were potassium chloride, calcium chloride, aluminum chloride, sodium benzoate, and magnesium sulfate.

After converting the resistivity measurements of IPC ohms/square, the procedure outlined in Example I was followed to generate a family of resistivity versus add-on rate curves for each compound (one curve for each of the relative humidities at which the resistivities of the samples were measured). Then, using the technique described in Example I, a resistivity/relative humidity curve for a take-up of 0.004 grams of salt per half standard sheet was developed for each compound. These curves, along with the curves for sodium chloride treated and untreated specimens, are shown in FIG. 6.

Figure 6:
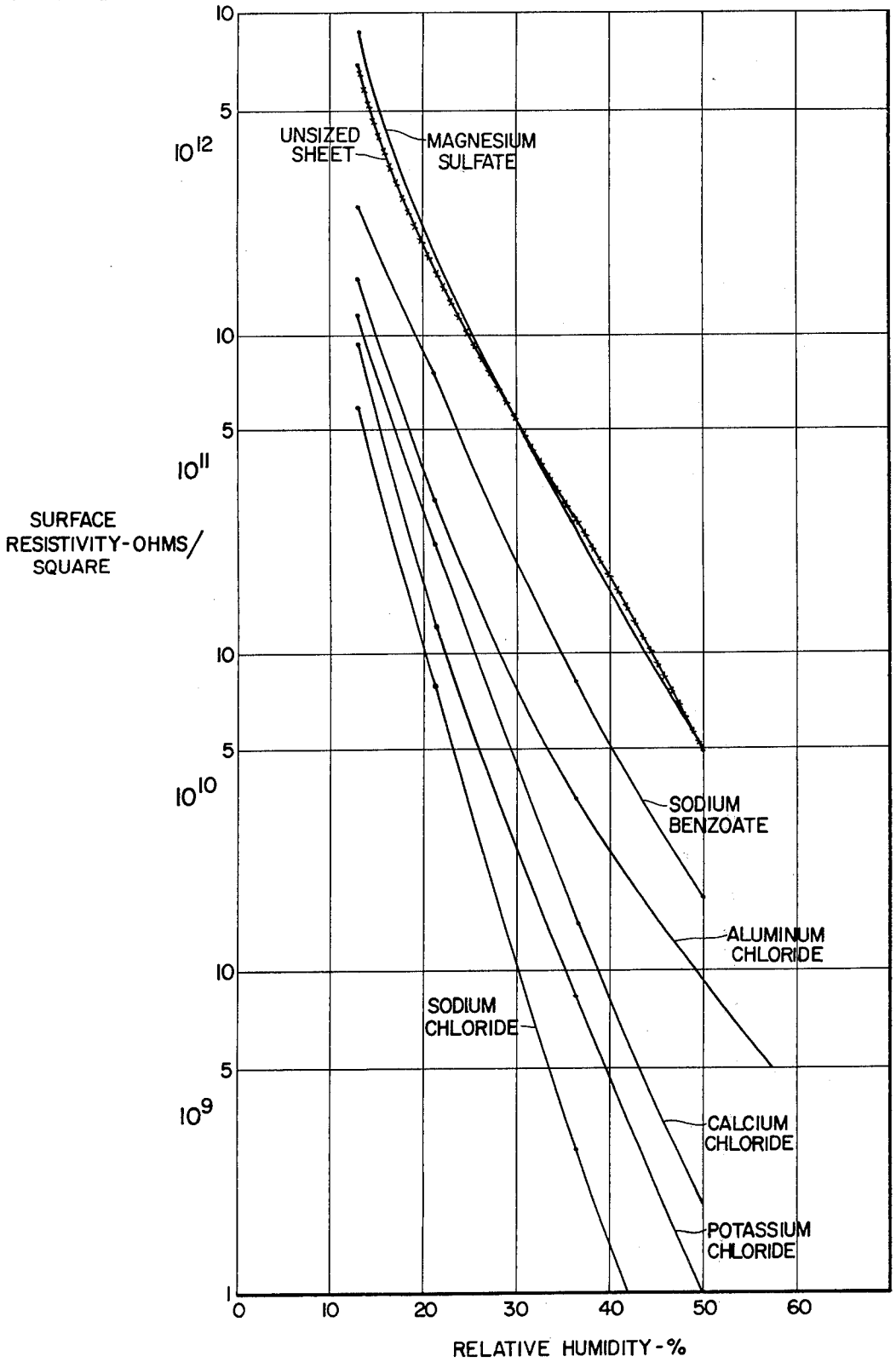
FIG. 6 is a chart showing the effect on surface resistivity that results from employing different, but representative, salts in the papers of the present invention.

A comparison of FIGS. 4 and 6 shows that salts vary in effectiveness, but that readily ionizable salts tend to have the same general effect on the resistivity of paper at low relative humidities. The data also shows that all but one of the representative salts produced resistivity characteristics of a character which makes papers treated with them usable for the purposes of the present invention.

The same graphical data also shows that both organic and inorganic salts can be used in making papers in accord with the principles of the present invention. In addition, the data shows that not all salts are indiscriminately useful for my purposes, but that care must be exercised to choose a salt which is readily ionizable. Finally, the data of FIGS. 6 and 9, taken together, makes it apparent that care must be taken to insure that the selected compound is added to the paper in amounts which will produce the requisite electrical properties.[7]

[7] It does not confirm the assertions of Matsunaga that organic compounds are more effective than inorganic salts in lowering the resistivity of paper at relative humidities below 50 percent.

I also pointed out above that the particular humectant employed, if one is used, in the practice of the present invention, will be selected on the basis of characteristics other than its effect on the electrical properties of the paper, which is negligible, at least as far as currently available humectants are concerned. The tests discussed in the following example confirm that the resistivity characteristics of paper in the environments to which the present invention relates are not altered to any significant extent by the substitution of one typical humectant for another.

EXAMPLE IV

Samples were coated with sizing solutions containing polyethlene glycol and Arlex[8], the resistivity of the samples at varying humidity levels measured, and resistivity versus the amount of the additive picked up by the specimens plotted, all as described in Example I. Resistivity versus relative humidity was then plotted for a pick-up weight of .002 grams per half standard sheet. The resulting curves are shown in FIG. 7 along with the curves for glycerin treated and untreated paper.

[8] Arlex in a commercially available humectant manufactured by the Atlas Chemical Company. It is an anhydrous, 80 percent solution of sorbitol.

It is apparent from the Figure just mentioned that the conventional humectants have little effect on the resistivity of paper, especially at low relative humidities. Therefore, as indicated above, the particular humectant employed in the practice of the present invention can be varied as long as it has the physical characteristics discussed above.

Figure 7:
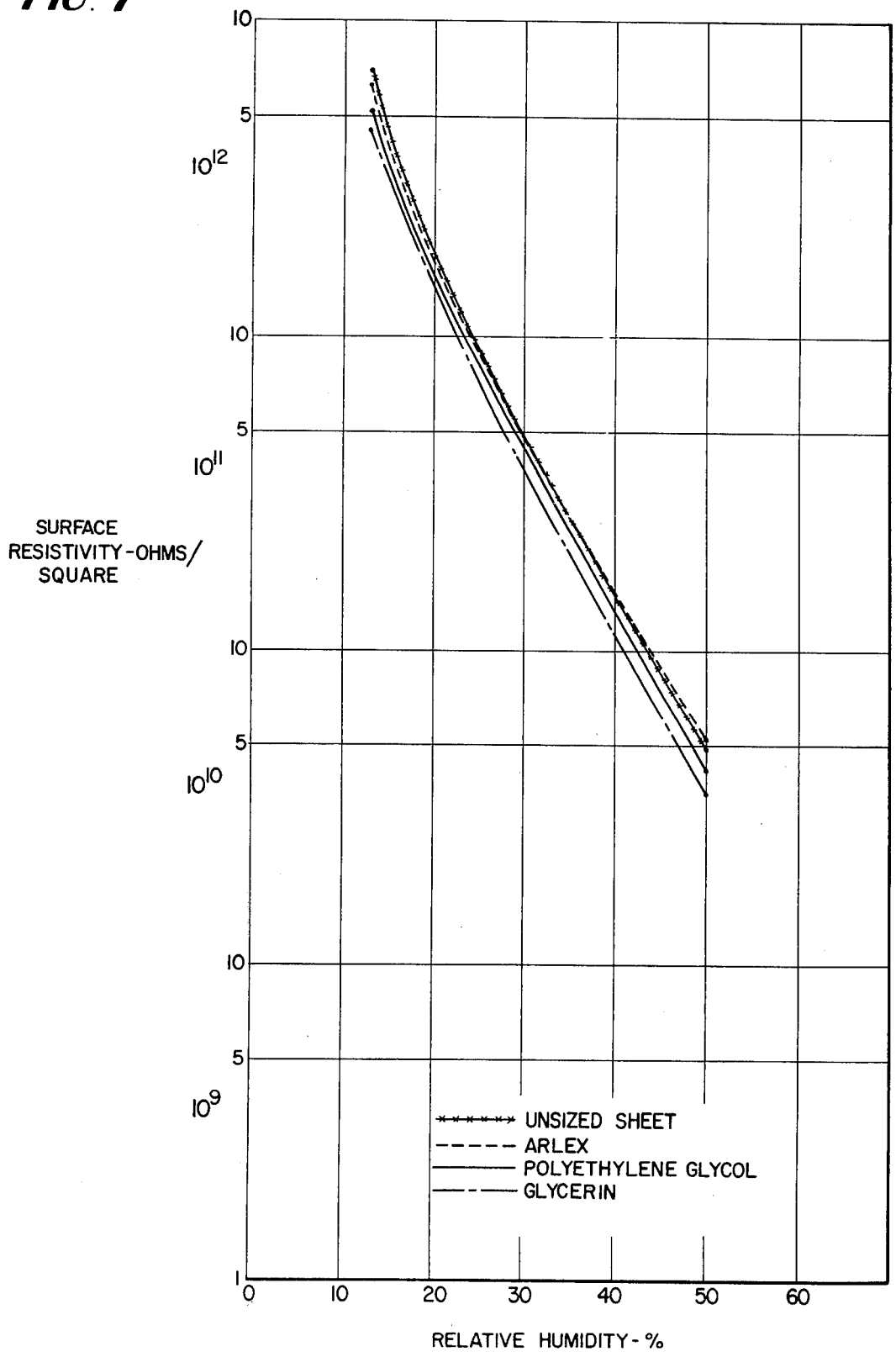
FIG. 7 is a chart showing the effect which varying or omitting a humectant has on the surface resistivity of papers.

Also, a comparison of FIG. 7 with FIG. 4 will further demonstrate that papers treated with a humectant alone are not suitable for the purposes of the present invention.

As indicated above, a binder will normally be added to the solution with which the paper is coated if the "coating" approach to tailoring electrical properties described above is employed. The function of this constituent is to improve the surface finish of the paper; it has no effect of any significance on the electrical properties of the paper as shown by the following example.

EXAMPLE V

Papers were coated with 7 percent solutions of an ethylated corn starch[9] and an oxidized corn starch[10] in the laboratory size press and the resistivities of the samples determined at varying levels of relative humidity following the procedure described in Example I. Then, resistivity versus relative humidity curves were plotted.

[9] Penford Gum 230 supplied by Penick & Ford.
[10] Onyx-M supplied by Union Starch Co.

Figure 8:
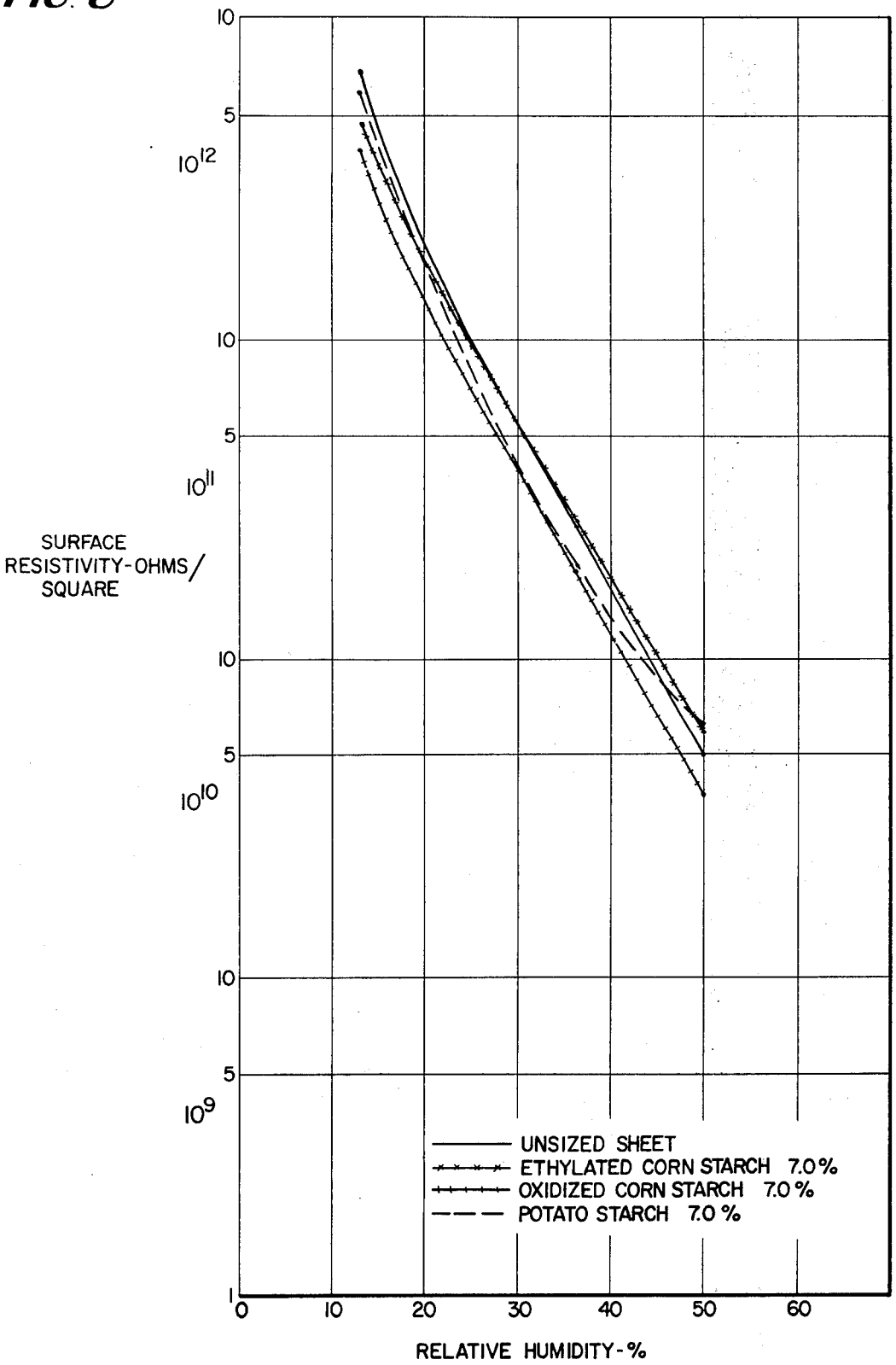
FIG. 8 is a graph showing that representative commercial binders have little effect on the electrical properties of paper.

The resulting curves are shown in FIG. 8 along with the curve for untreated paper and the curve for the paper treated with Co-Star converted potato starch.

The graphically presented data shows that the particular binder employed is not critical as far as the present invention is concerned because it has no effect on the electrical properties of the paper. FIG. 9 also demonstrates that the addition of a binder alone to paper will not make the paper suitable for the purposes of the present invention.

In the foregoing examples the tailoring of the electrical properties of paper as required for the present invention by the addition of an ionizable salt in a coating solution has been emphasized. I reiterate, however, that other approaches can be used as long as the requisite electrical properties are obtained; one approach I specifically identified is to incorporate a readily ionizable salt in the stock before the paper is formed. Another approach is to tailor the humectant or the binder so that the additive will produce the requisite electrical characteristics and make the salt or the salt and humectant unnecessary. Still other techniques for producing the requisite electrical characteristics will readily occur to those skilled in the arts to which the present invention pertains.

The invention may be embodied in forms other than those described above without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. In the method of producing a visual image on a copy member comprising the steps of forming a latent electrostatic image on an electrostatically chargeable, photoconductive member by producing a patterned distribution of electrical charges thereon; applying to said photoconductive member a finely divided, pigmented toner which will adhere to those areas of the member where a charge is present; transferring said toner from said photoconductive member to an image receiving surface of an uncharged copy member made of paper; and heating the copy member to fuse the toner thereto in a high temperature environment in which the relative humidity ranges down to 10 percent or lower, the improvement wherein the toner is transferred to a copy member which is resistant to the build-up of static charges on its image receiving surface in the low humidity, high temperature environment in which the copy member is located while the toner is fused thereto and which comprises means for making said image receiving surface counteractive to the retention of static charges which are transferred with said toner particles to said image receiving surface and a web of cellulosic material, said means being an electrical conductivity imparting additive distributed on or in the web in an amount sufficient to reduce the surface resistivity of the image receiving surface to from not more than $3 \times 10^{11}$ ohms/square at a relative humidity of 25 percent up to not more than $60 \times 10^{11}$ ohms/square at a relative humidity of 10 percent to thereby facilitate the dissipation of static charges therefrom in said low humidity, high temperature environment and thereby keep said charges from remaining on said image receiving surface and creating a tendency for the copy member to stick to another charged copy member or to parts of the copy making apparatus.

2. The method of claim 1, wherein the conductivity imparting additive distributed in the paper on which the visual image is formed is an ionizable salt and wherein said cellulosic web has distributed in the surface portions thereof an amount of said ionizable salt which is sufficient to produce a surface resistivity of not more than about $0.9 \times 10^{11}$ IPC ohms/square at a relative humidity of 25 percent and a surface resistivity of not more than about $25 \times 10^{11}$ IPC ohms/square at a relative humidity of 10 percent.

3. The method of claim 1, wherein said conductivity imparting additive comprises at least about 0.012 grams per standard sheet of a readily ionizable salt dispersed in the copy member and extending into the image receiving surface portions thereof.

4. The method of claim 3, wherein the ionizable salt dispersed in the paper on which the visual image is formed is free of coloring effect on the cellulosic web, soluble in water, an electrolyte, non-volatile, and discoloration resistant at temperatures of up to about 250°C.

5. The method of claim 4, wherein the ionizable salt is sodium chloride.

6. The method of claim 3, wherein the paper on which the visual image is formed also includes a humectant dispersed in the image receiving surface portions of the cellulosic web constituting said paper to increase the effectiveness of the ionizable salt in dissipating static charges at low relative humidities, said humectant being soluble or miscible in water and being free of coloring effect on said cellulosic web, and said humectant having a sufficiently high boiling point to withstand temperatures of up to about 250°C. without significant evaporation from the web.

7. The method of claim 6, wherein the humectant is glycerin and is present in a ratio of at least about 1½ pounds of glycerin per ton of cellulosic web.

8. The method of claim 3, wherein the paper on which the visual image is formed also includes a binder dispersed in the surface portions of the cellulosic web constituting said paper.

9. The method of claim 8, wherein the binder is an enzyme converted potato starch.

* * * * *